US006289612B1

(12) United States Patent
Kent

(10) Patent No.: US 6,289,612 B1
(45) Date of Patent: Sep. 18, 2001

(54) FOOTWEAR HAVING CONCEALED STORAGE CAVITY FOR PERSONAL ITEMS

(76) Inventor: Dorene Jean Kent, 1315 Washington St., Evanston, IL (US) 60202

( * ) Notice: Subject to any disclaimer, the term of this patent is extended or adjusted under 35 U.S.C. 154(b) by 0 days.

(21) Appl. No.: 09/489,204

(22) Filed: Jan. 21, 2000

(51) Int. Cl.[7] ..... A43B 23/00

(52) U.S. Cl. ..... 36/136; 36/42; 36/132; 36/36 R

(58) Field of Search ..... 36/136, 132, 42, 36/36 R, 35 A

(56) References Cited

U.S. PATENT DOCUMENTS

| | | | | |
|---|---|---|---|---|
| 348,688 | * | 9/1886 | Putnam et al. | 36/136 |
| 473,590 | * | 4/1892 | Randolph | 36/36 R |
| 922,499 | * | 5/1909 | Molitor | 36/136 |
| 1,085,254 | * | 1/1914 | Halley | 36/136 |
| 1,751,069 | * | 3/1930 | Blain | 36/136 |
| 2,070,229 | * | 2/1937 | Gentile | 36/42 |
| 2,478,411 | * | 8/1949 | Martin | 36/136 |
| 2,897,609 | * | 8/1959 | Bodkin | 36/136 |
| 2,904,901 | * | 9/1959 | Goldstein | 36/136 |
| 3,174,234 | * | 3/1965 | Weitzner | 36/136 |
| 3,473,241 | * | 10/1969 | Parma | 36/42 |
| 3,805,418 | * | 4/1974 | Matuka et al. | 36/34 A |
| 5,921,008 | * | 7/1999 | Ruff | 36/136 |
| 5,996,261 | * | 12/1999 | Nelson | 36/136 |
| 6,094,844 | * | 8/2000 | Potts | 36/136 |

* cited by examiner

*Primary Examiner*—Paul T. Sewell
*Assistant Examiner*—Troy Arnold
(74) *Attorney, Agent, or Firm*—Jonathan Spangler

(57) ABSTRACT

The present invention relates to footwear having a concealed storage cavity for storing personal items, including but not limited to, keys, money, and medication, for increased personal safety and increased convenience.

9 Claims, 16 Drawing Sheets

FOOTWEAR HAVING CONCEALED STORAGE CAVITY FOR PERSONAL ITEMS

BACKGROUND OF THE INVENTION

I. Field of the Invention

The present invention relates generally to footwear. More particularly, the present invention relates to footwear having a concealed cavity for storing personal items.

II. Discussion of the Prior Art

The task of carrying personal items on the person via traditional article-carrying means (such as purses, wallets, or the like) has several significant drawbacks. One major drawback relates to personal safety. In recent times, crimes involving theft from persons utilizing traditional article-carrying means have become increasingly common. Criminals oftentimes select their victims after assessing whether the person is likely to have certain valuables in their possession. In the case of women, for example, a purse may be viewed as an ample target for money, credit cards, and other valuables. In the case of men, thieves are skillful at detecting the presence of wallets in pockets or otherwise. Thus, carrying personal items via traditional article-carrying means presents an increased likelihood of being targeted by thieves.

Another significant drawback involves the inconvenience of carrying such traditional article-carrying means. Women, for example, oftentimes find it cumbersome and inconvenient to carry purses with them, particularly in crowded social environments such as dance clubs or bars. Moreover, many men find it uncomfortable to carry wallets in the traditional "back pocket" manner, which is known to cause certain lower back and/or leg pain.

The present invention is directed at eliminating, or at least reducing, the foregoing drawbacks associated with the prior art.

BRIEF SUMMARY OF THE INVENTION

In one broad aspect of the present invention, an article of footwear is provided having a foot-receiving portion, a sole portion coupled to the foot-receiving portion, and a heel portion coupled to the sole portion, wherein a concealed storage cavity is formed in at least one of the heel portion and the sole portion.

In yet a further broad aspect of the present invention, a method of carrying personal items is provided, comprising the steps of: (a) forming a concealed storage cavity within at least one of the sole portion and the heel portion of an article of footwear; and (b) storing personal items within said concealed storage cavity.

Still another broad aspect of the present invention involves a method of manufacturing an article of footwear, comprising the step of forming a concealed storage cavity within at least one of the sole portion and the heel portion of the article of footwear with the purpose of containing personal items of a wearer of the footwear.

BRIEF DESCRIPTION OF THE DRAWINGS

The following description of the preferred embodiments of the present invention will be better understood in conjunction with the appended drawings, in which.

DETAILED DESCRIPTION OF THE INVENTION

The present invention involves providing a concealed storage cavity within an article of footwear for holding personal items such as, but not limited to, keys, money, credit cards, medication, lipstick, tampons, perfume, and tickets. The concealed storage cavity of the present invention provides a convenient manner of storing personal items without the need for traditional article-carrying means such as purses, wallets, etc. Moreover, maintaining these personal items in a concealed fashion within footwear minimizes the chance of attracting criminals who target persons carrying traditional article-carrying means, thereby improving the safety of the wearer. The present invention provides these advantages in virtually any type of footwear, only a few of which are described below. It is to be understood that the present invention finds application in a wide variety of types of footwear not shown. Moreover, while described below with reference to a single article of footwear (i.e. right or left foot), it is to be understood that the present invention is equally applicable to both articles of footwear comprising a pair.

Figure 1:
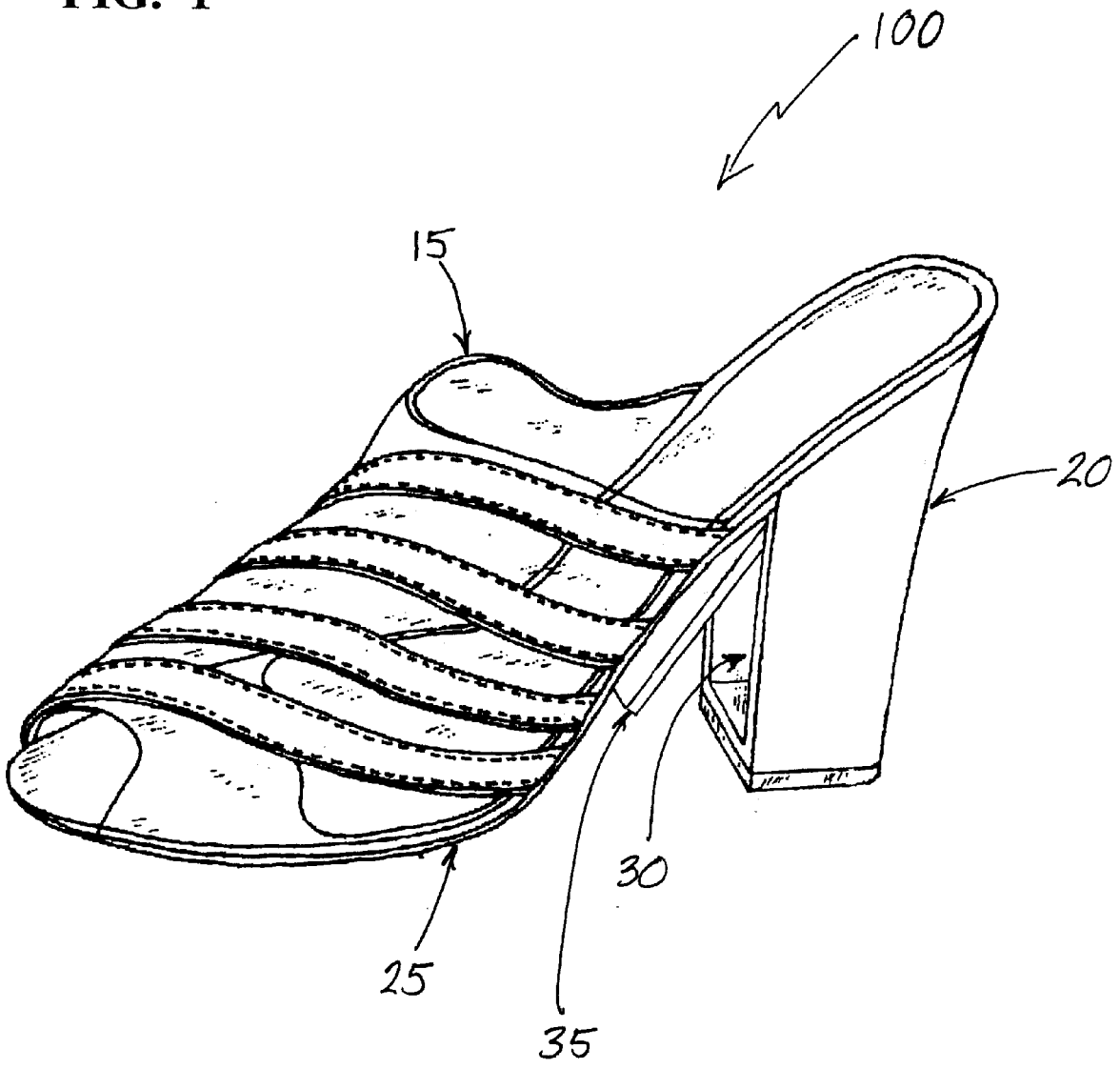
FIG. 1 is a perspective view of a women's dress shoe having a concealed storage cavity formed in the which is accessed via a hinged door according to the present invention.

FIG. 1 illustrates a women's shoe 100 constructed according to one aspect the present invention. Generally speaking, shoe 100 includes a foot-receiving portion 15, a heel portion 20, and a sole portion 25. In an important aspect of the present invention, the heel portion 20 includes a concealed storage cavity 30 formed therein. A door member 35 is hingedly coupled to the heel portion 20 so as to provide selective access to the interior of the concealed storage cavity 30. The door member 35 may be secured in position to close the concealed storage cavity 30 via any number of commonly known closure mechanisms. These may include, but are not necessarily limited to, snap-type arrangements (i.e. providing snaps and corresponding mating portions on the door 35 and the heel 20), mating fabric-type arrangements (i.e. providing mating Velcro® sections on the door 35 and heel 20), spring-loaded arrangements (i.e. providing a spring in conjunction with the hinge for biasing the door 35 into a normally closed position that may be selectively biased open by a user), magnet arrangements (i.e. providing magnets on or within the door 35 and/or heel 20 for magnetically maintaining the door 35 in a closed position) and selectively positional hinge arrangements (i.e. providing a hinge capable of "snapping" the door member 35 between an open position and a closed position).

Figure 2:
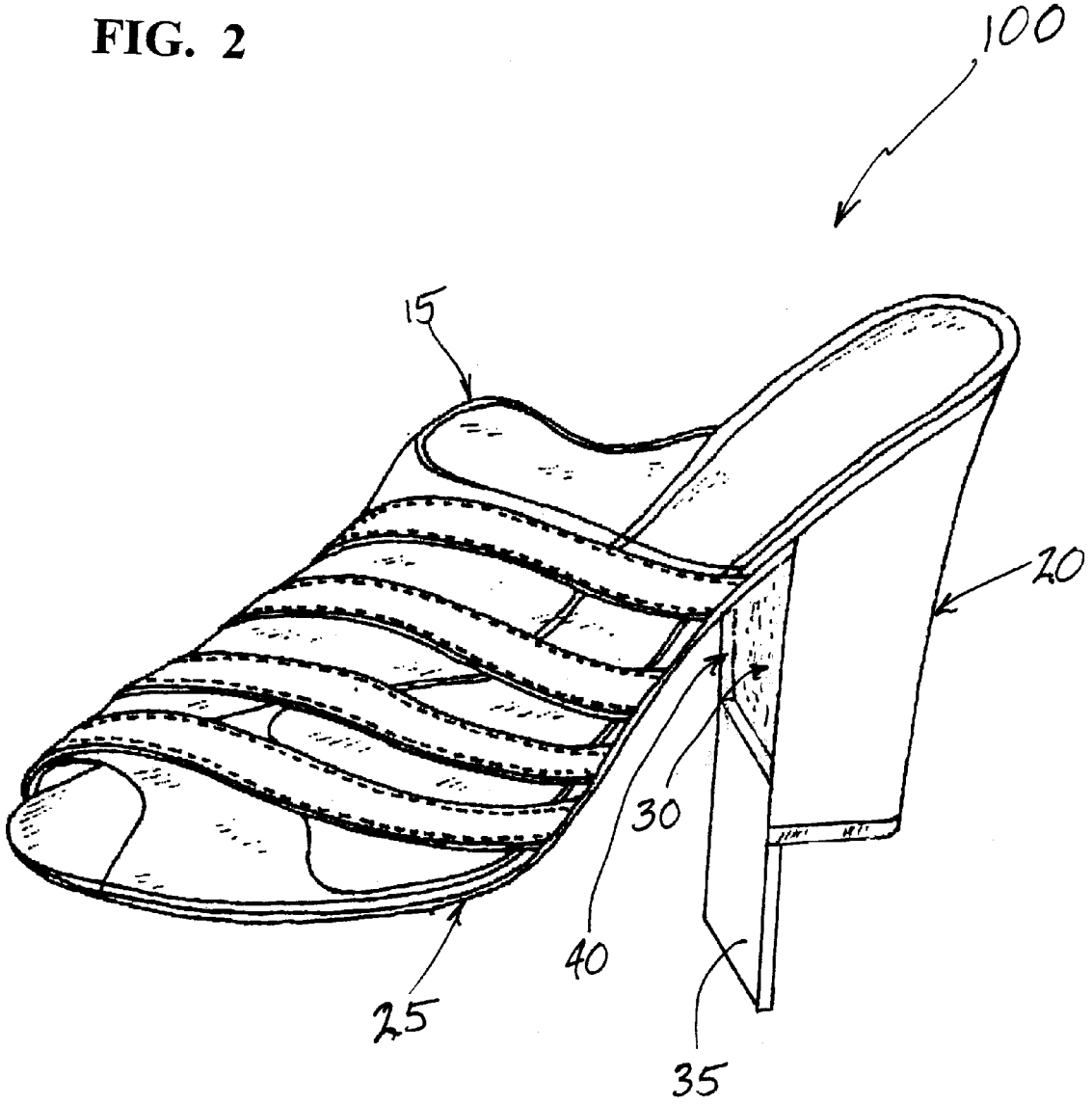
FIG. 2 is a perspective view of a women's dress shoe having a concealed storage cavity formed in the heel which is accessed via a sliding door according to the present invention.

FIG. 2 illustrates a variant of the embodiment shown in FIG. 1, wherein the door member 35 is slidably engageable within grooves 40 formed in the heel 20 to provide selective access to the concealed storage cavity 30. The door member 35 may be maintained in a closed position (fully raised within heel 20) via any number of commonly known closure mechanisms. These may include, but are not necessarily limited to, the snap-type arrangements and mating fabric-type arrangements described above, as well as notch-detent arrangements (i.e. providing a detent extending outwardly from the groove 40 for matingly engaging with a notch formed along the side of the door 35), and a bottom locking arrangement (i.e. providing a slidable member on the bottom of the heel 20 for selectively prohibiting the downward sliding ability of the door member 35). It is to be understood that the closure mechanisms described above with reference to FIGS. 1 and 2 are set forth by way of example only. Furthermore, it is to be readily understood that, according to the present invention, these and other exemplary closure mechanisms may be employed to selectively open and close the concealed storage cavities 30 formed in the footwear disclosed herein, as well as other types of footwear not shown.

Figure 3:
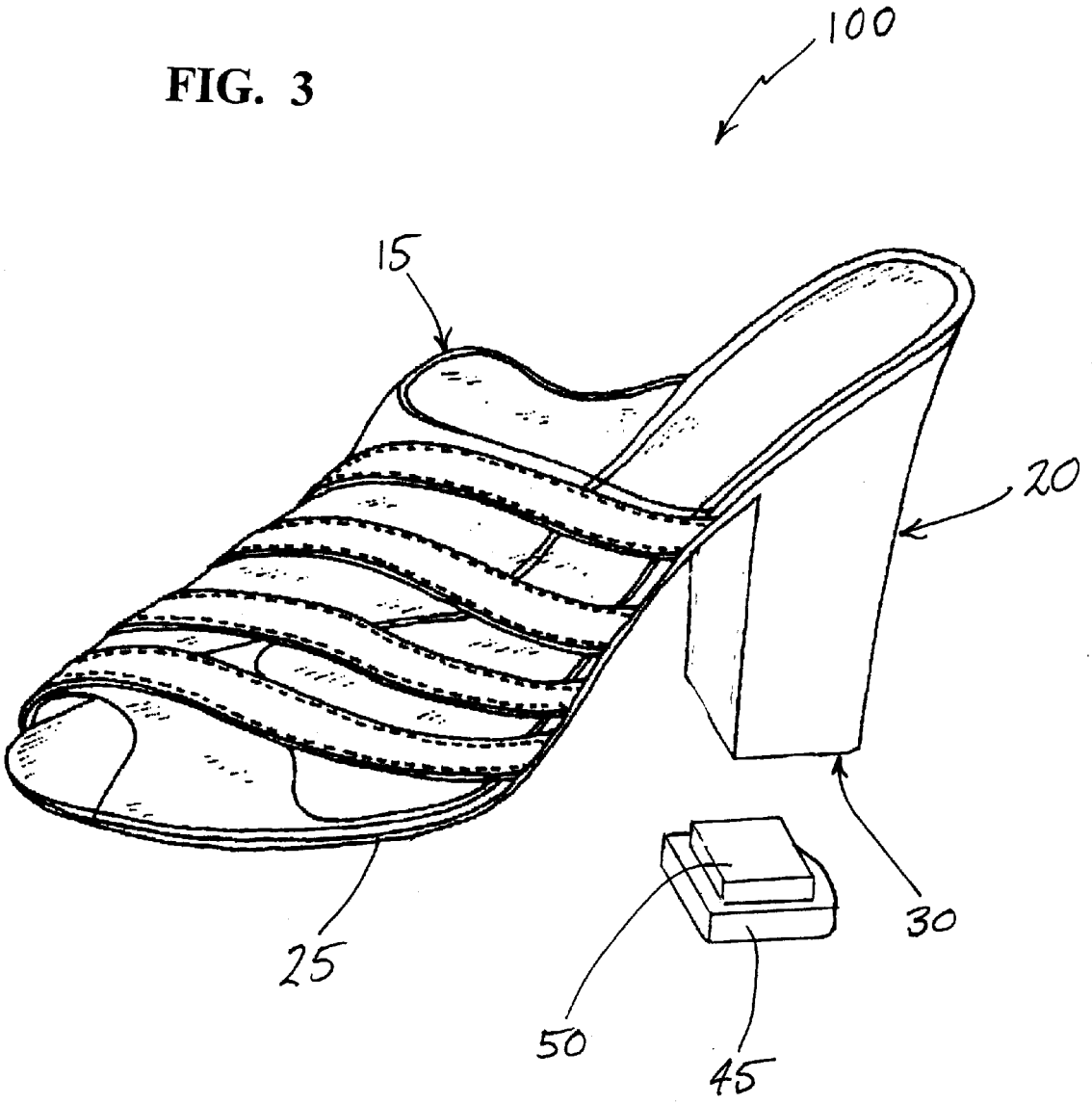
FIG. 3 is a perspective view of a women's dress shoe having a concealed storage cavity formed the heel which is accessed via a removable heel bottom according to the present invention.

FIG. 3 illustrates a still further variant of the embodiment shown in FIG. 1, wherein the concealed storage cavity 30 may be selectively opened and closed through the use of a lower heel portion 45 capable of being selectively removed from the bottom of heel 20. The lower heel portion 45 in this embodiment is equipped with a raised portion 50 for engagedly mating with the heel 20 to close the concealed storage cavity 30. The lower heel portion 45 may be equipped with any number of well known closure mechanisms including, but not limited to, the snap-type arrangements, mating fabric-type arrangements, and notch-detent arrangements described above.

Figure 4:
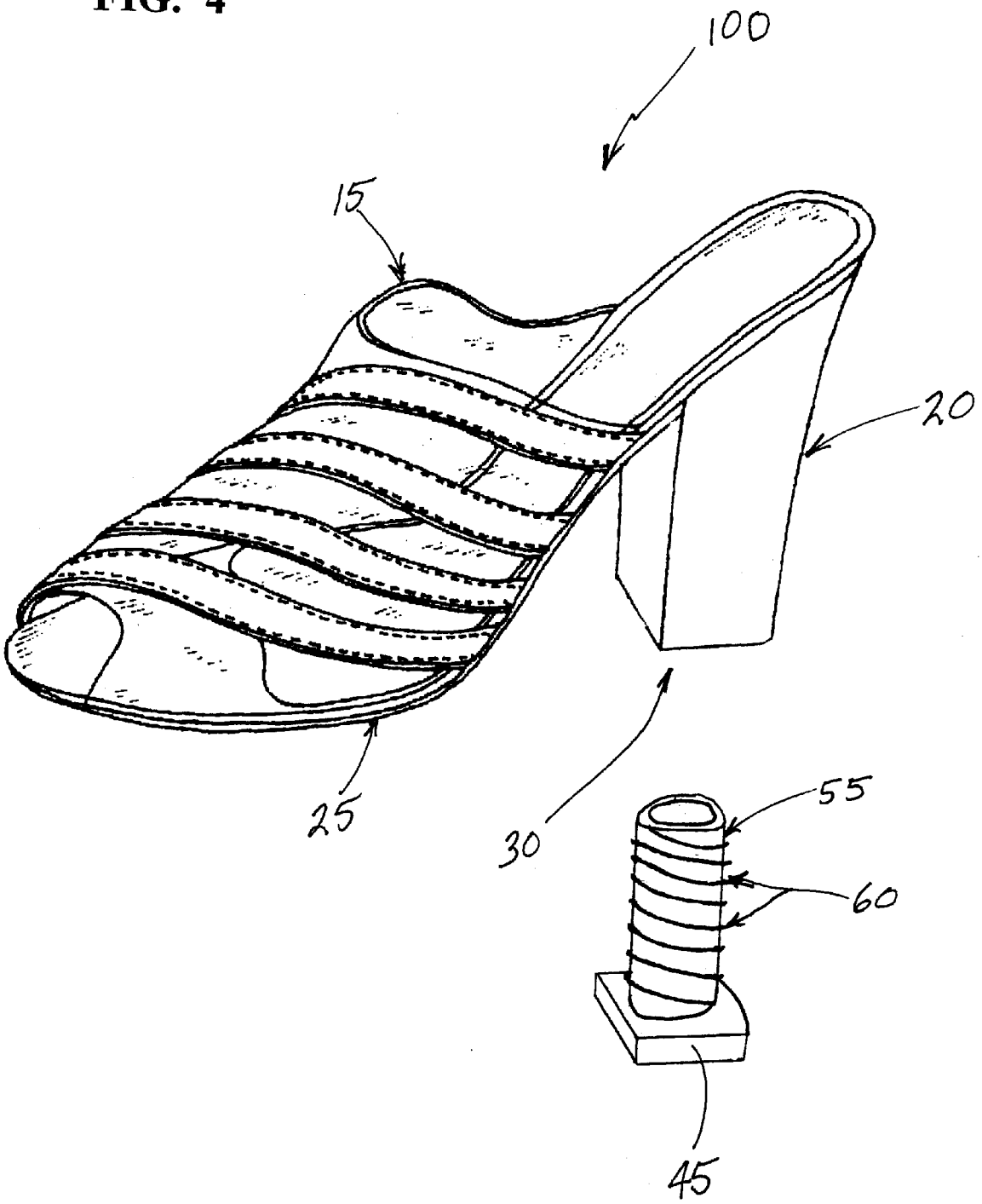
FIG. 4 is a perspective view of a women's dress shoe having a concealed storage cavity formed the heel which is accessed via a removable heel bottom having an elongated cylinder coupled thereto according to the present invention.

FIG. 4 illustrates a variant of the embodiment shown in FIG. 3, wherein the lower heel portion 45 includes an article-containment cylinder 55 extending generally perpendicularly from the heel portion 45. In this embodiment, the closure mechanism is a threaded engagement arrangement between a thread 60 formed on the exterior of the article-containment cylinder 55 and corresponding grooves formed within the concealed storage cavity 30. It is to be understood, however, that any number of additional closure mechanisms may be employed to selectively further secure the article containment cylinder 55 within the heel 20, including, but not limited to, the snap-type arrangements, mating fabric-type arrangements, and notch-detent arrangements described above.

Figure 5:
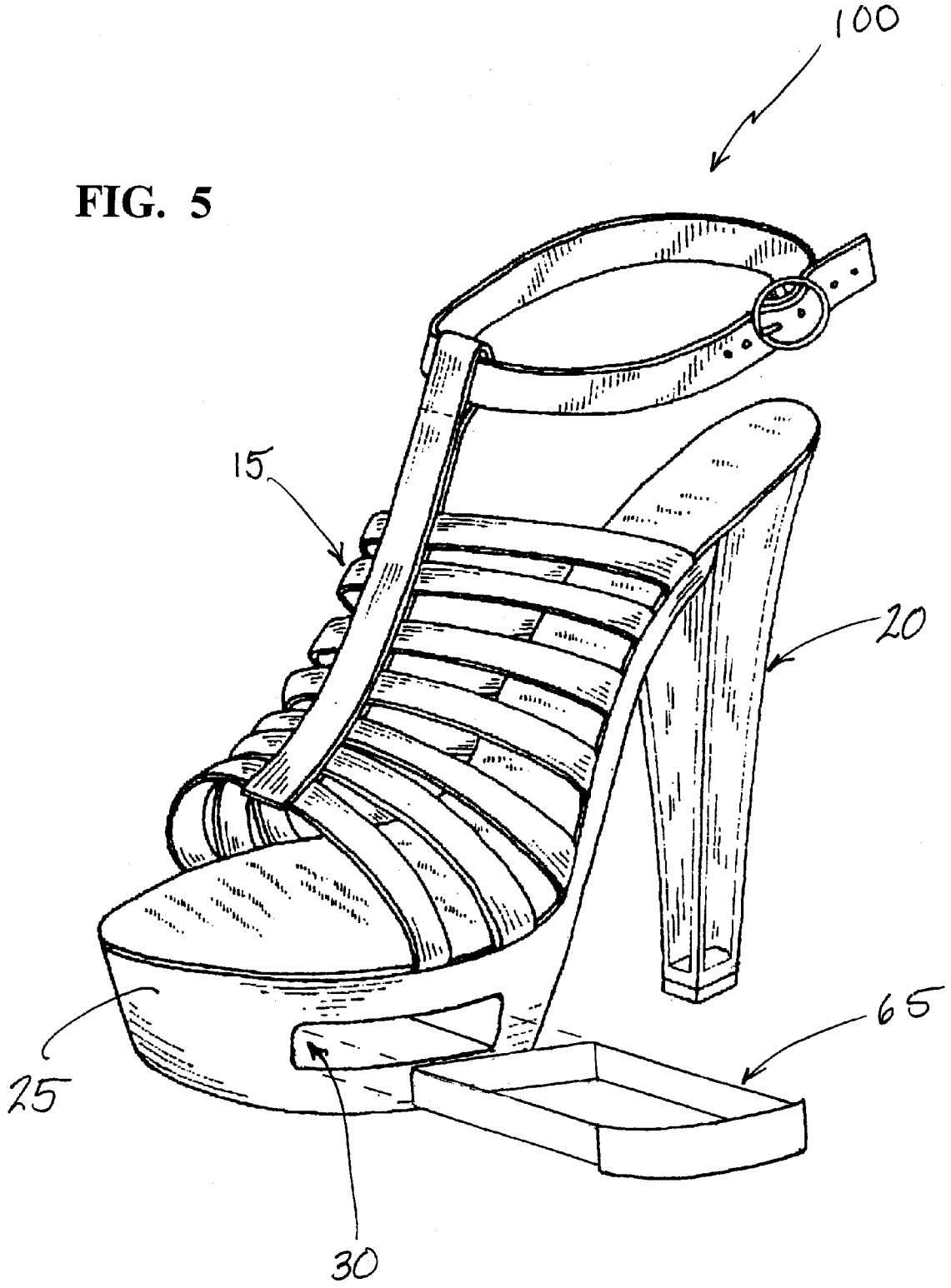
FIG. 5 is a perspective view of a women's dress shoe having a concealed storage cavity formed the sole and a removable tray member according to the present invention.

FIG. 5 illustrates a further aspect of the present invention, wherein the sole 25 of women's shoe 100 has an increased thickness with the concealed storage cavity 30 formed therein. In this embodiment, an article-containment tray 65 is provided for slideable engagement within the concealed storage cavity 30. The article-containment tray 65 may optionally be equipped with a lid member (not shown) and may be secured within the concealed storage cavity 30 via any number of well known closure mechanisms including, but not limited to, those described above.

Figure 6:
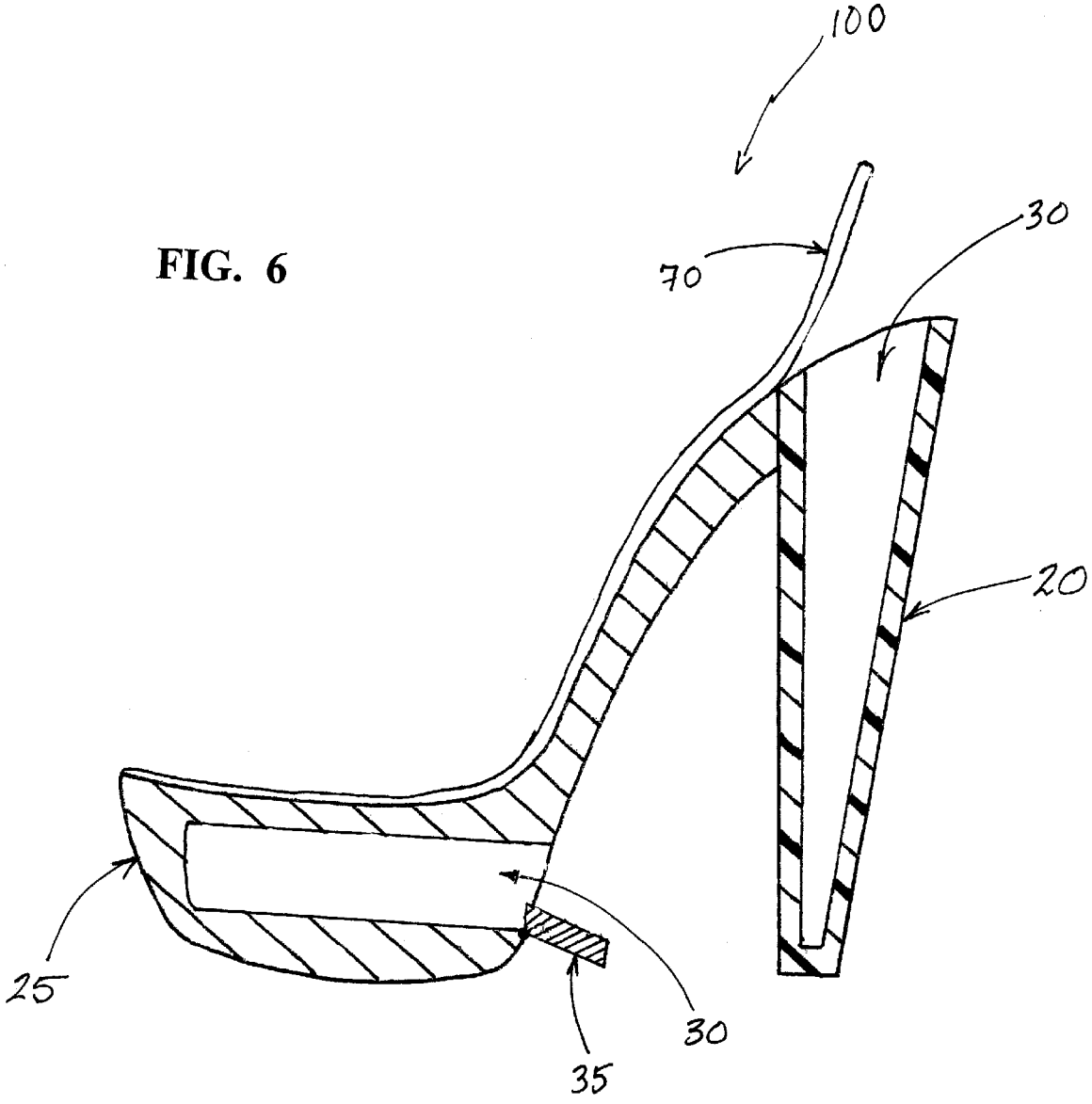
FIG. 6 is a side cross-sectional view of a women's dress shoe of the type shown in FIG. 5 having a concealed storage cavity formed in the heel and the sole according to the present invention.

FIG. 6 is a partial sectional view illustrating a variant of the embodiment shown in FIG. 5, wherein concealed storage cavities 30 may be formed in both the heel 20 and sole 25. A top sole layer 70 (upon which the foot of the wearer rests) may be selectively raised and lowered from the top of the heel 20 to open and close the concealed storage cavity 30 therein. The concealed storage cavity 30 within the sole 25 may be accessed through the use of a hinged door 35. The door member 35 may be secured in position to close the concealed storage cavity 30 via any number of closure mechanisms including, but are not necessarily limited to, those described above. Through this embodiment (and others to follow) it should be apparent that the concealed storage cavity 30 within the sole 25 may be accessed from any side, including but not limited to, the back entrance shown in FIG. 6.

Figure 7:
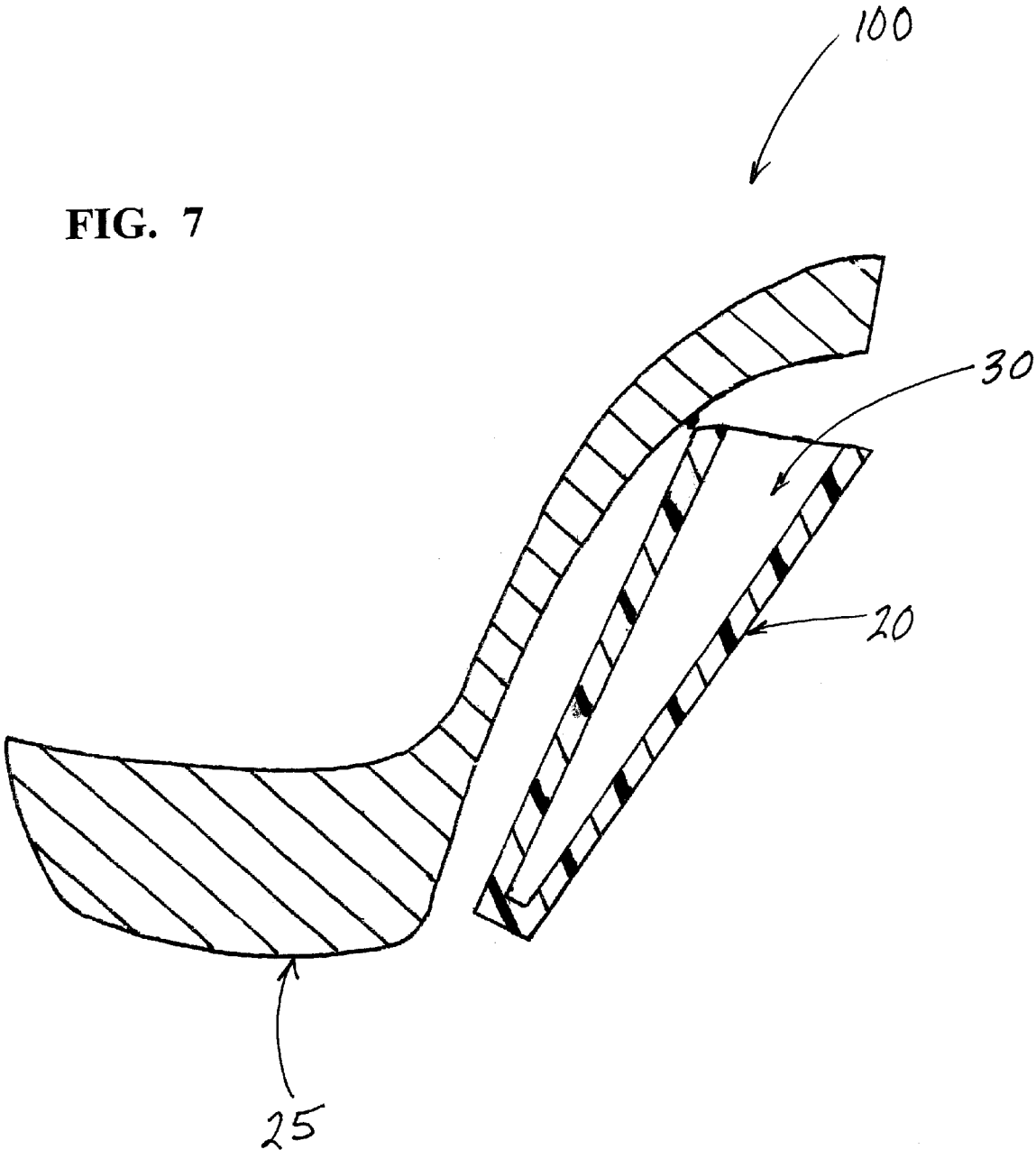
FIG. 7 is a side cross-sectional view of a women's shoe of the type shown in FIG. 5 having a concealed storage cavity formed in the heel which is accessed via a hinged heel according to the present invention.
Figure 8:
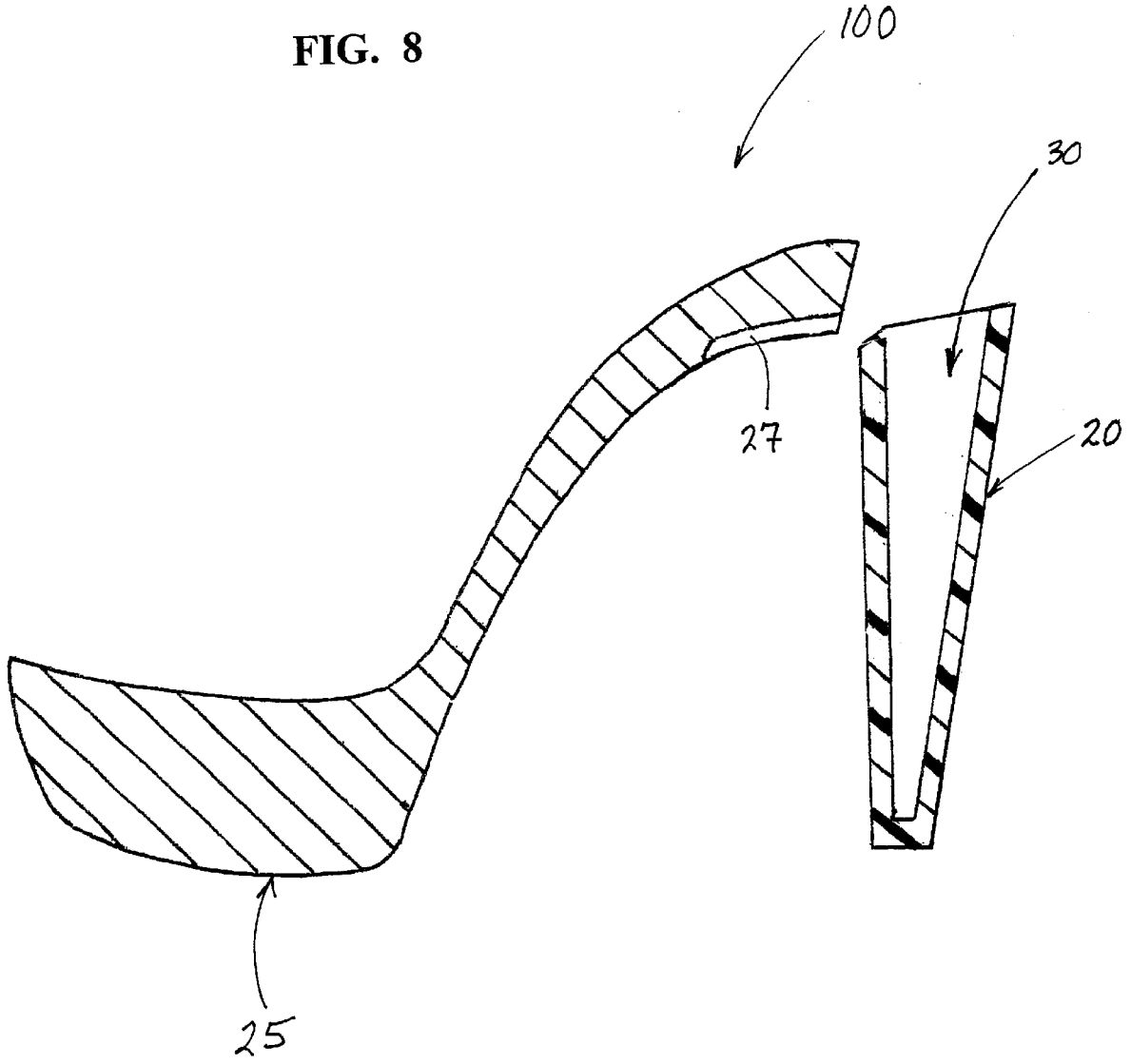
FIG. 8 is a side cross-sectional view of a women's shoe of the type shown in FIG. 5 having a concealed storage cavity formed in the heel which is accessed by slideably removing the heel from the sole according to the present invention.
Figure 9:
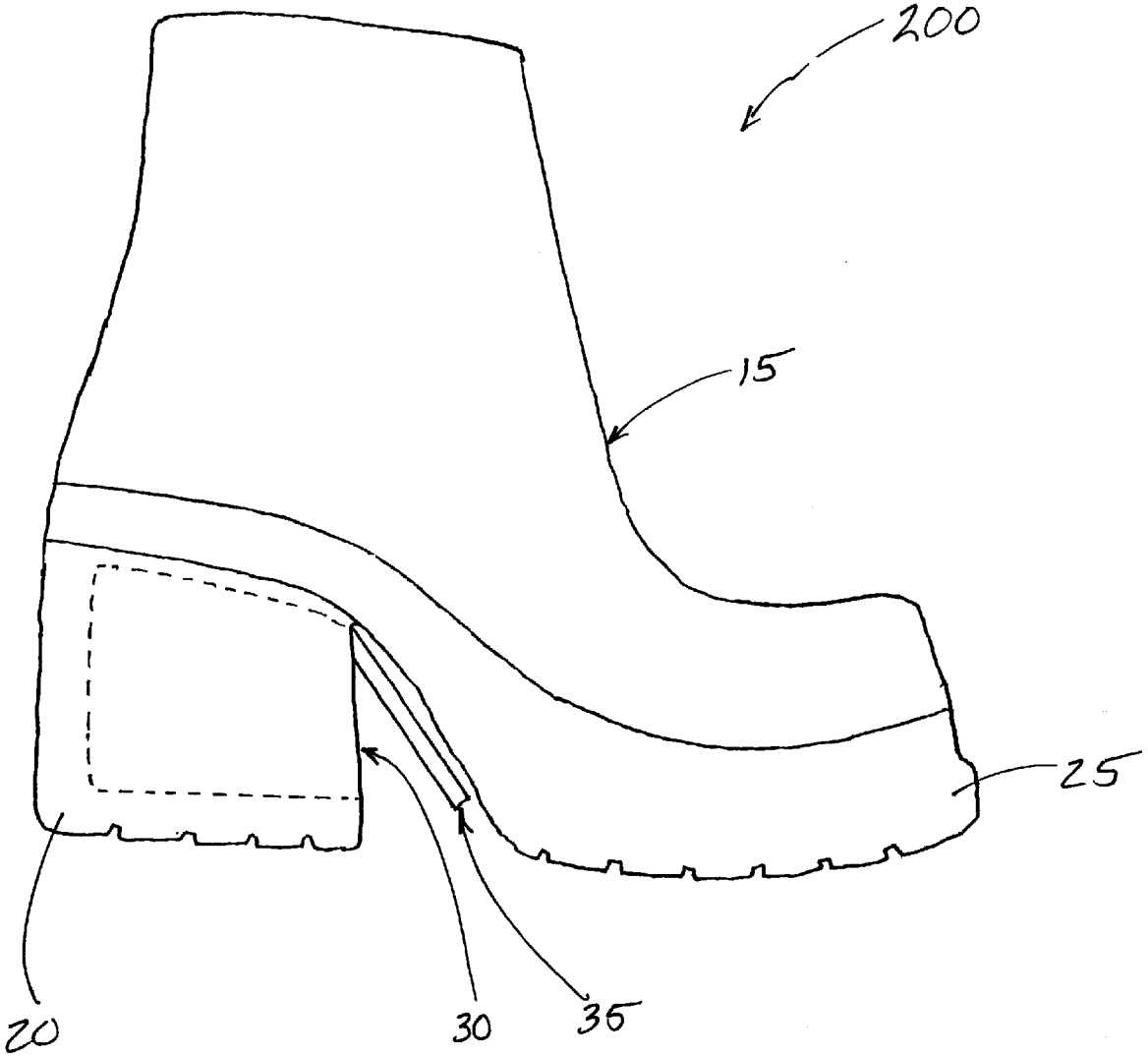
FIGS. 9 and 10 are side views of a boot-type article of footwear having a concealed storage cavity formed in the heel which is accessed via a hinged door according to the present invention.
Figure 10:
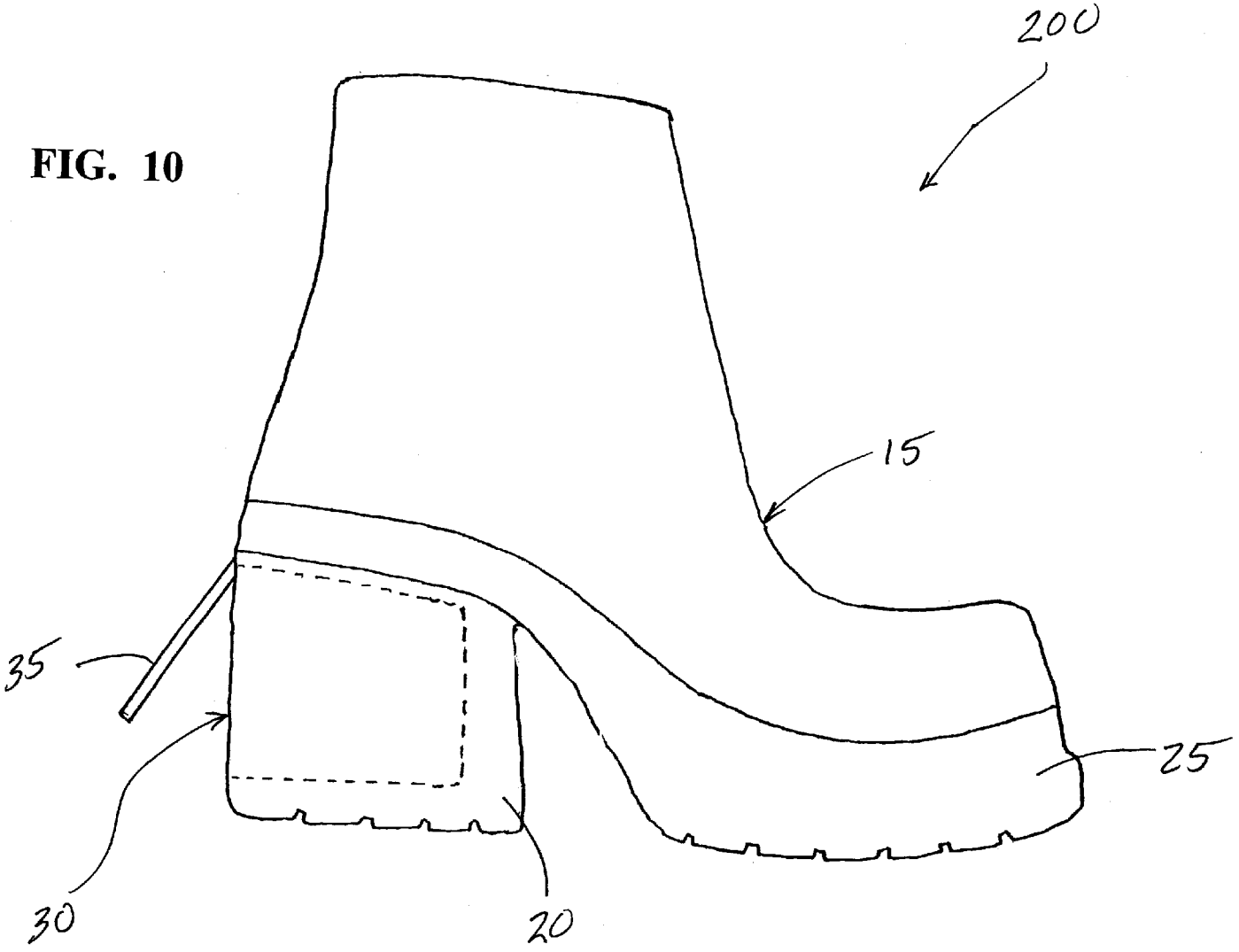

FIGS. 7 and 8 illustrate variants of the embodiment shown in FIGS. 5 and 6, wherein the concealed storage cavity 30 is formed within the heel 20 and the heel 20 is selectively moveable to gain access to the concealed storage cavity 30. In FIG. 7, the heel 20 is hingedly coupled to the sole 25 of the women's shoe 100 such that the heel 20 may be hingedly rotated to and from the sole portion 25 to selectively gain access to the concealed storage cavity 30. In FIG. 8, the heel 20 is selectively removable from the sole portion 25, such as by equipping the sole portion 25 with a groove 27 capable of slideably receiving a cooperating engagement member (not shown) provided on the heel 20. In this fashion, the heel 20 may thus be selectively removed from the sole portion 25 to gain access to the concealed storage cavity 30. The heel 20 and/or sole portion 25 may be further equipped with any number of well-known closure mechanisms for securing the heel 20 in position within the groove 27 of the sole portion 25 including, but not limited to, those described above.

Figure 11:
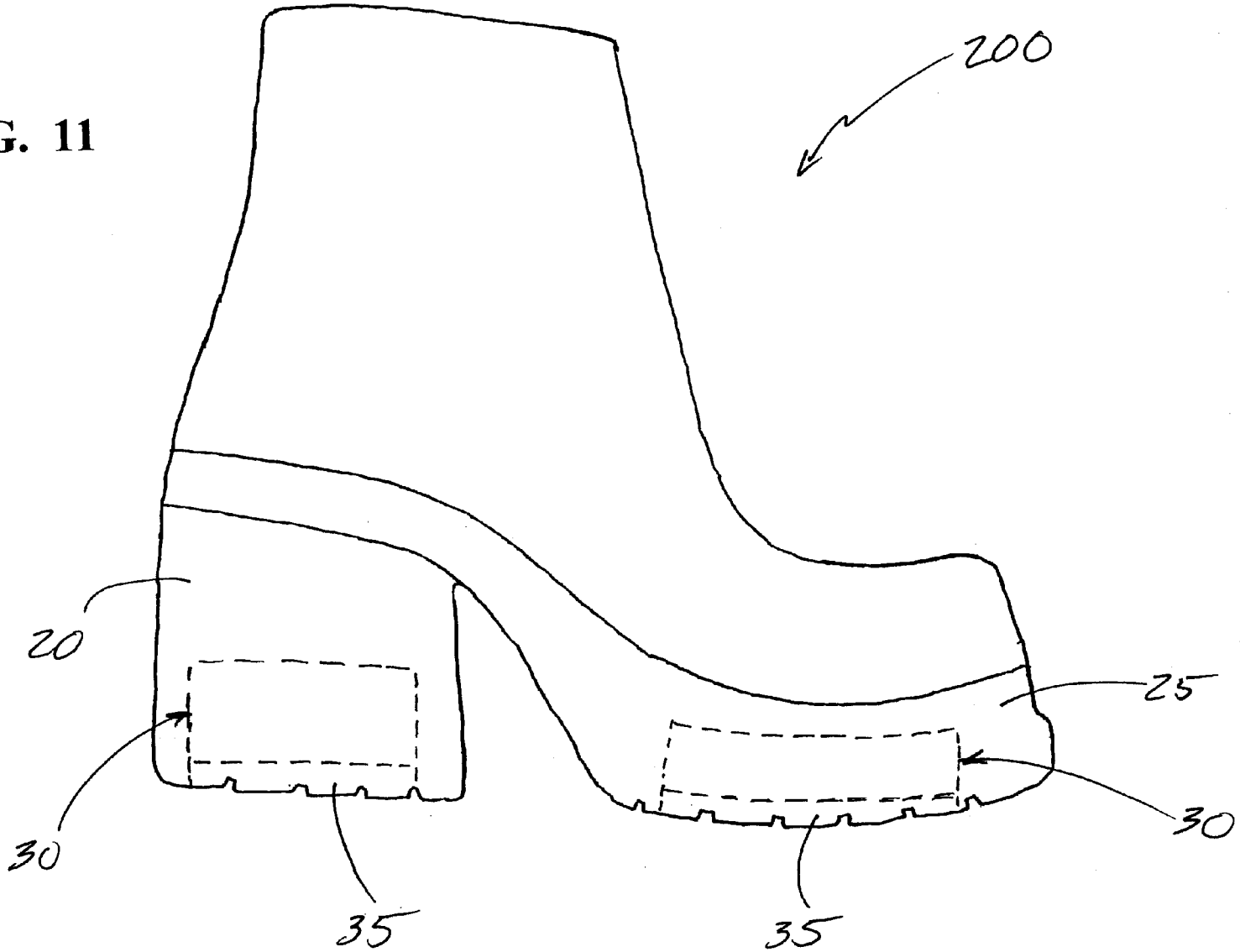
FIG. 11 is a side view of a boot-type article of footwear having concealed storage cavities formed in the heel and sole portions which are accessed via hinged doors according to the present invention.
Figure 12:
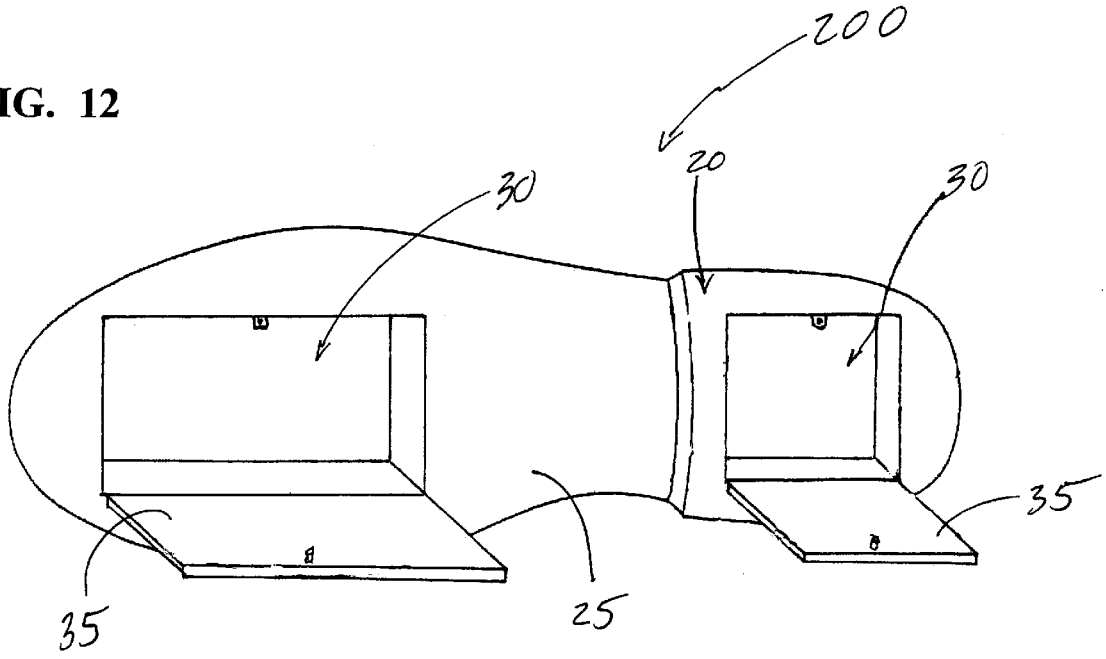
FIG. 12 is a bottom view of the boot-type article of footwear shown in FIG. 11 with concealed storage cavities formed in the heel and sole portions which are accessed via hinged doors according to the present invention.
Figure 13:
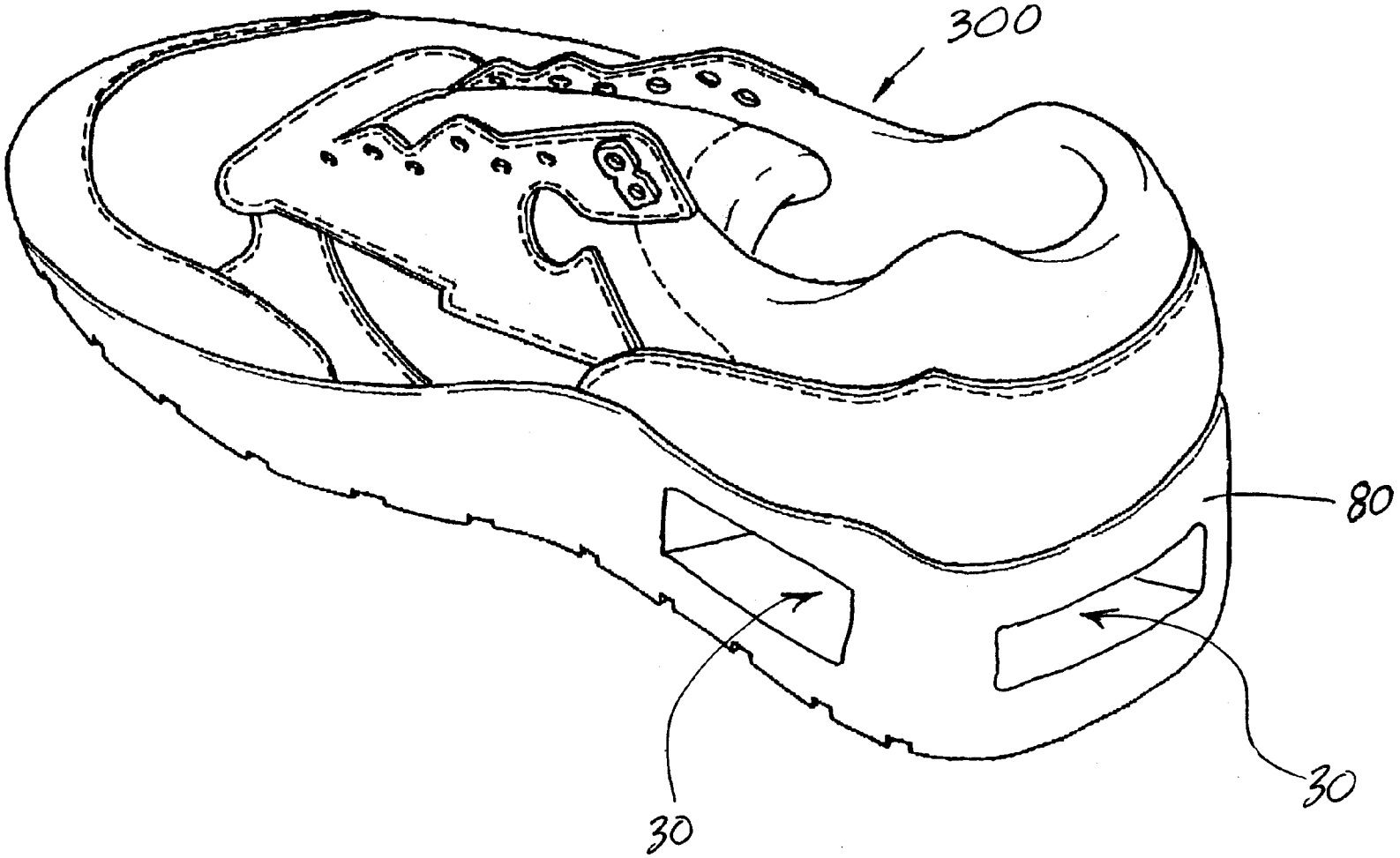
FIG. 13 is a perspective view of a sports shoe having a concealed storage cavity formed in the sole/heel area which is accessed via one or more apertures according to the present invention.
Figure 14:
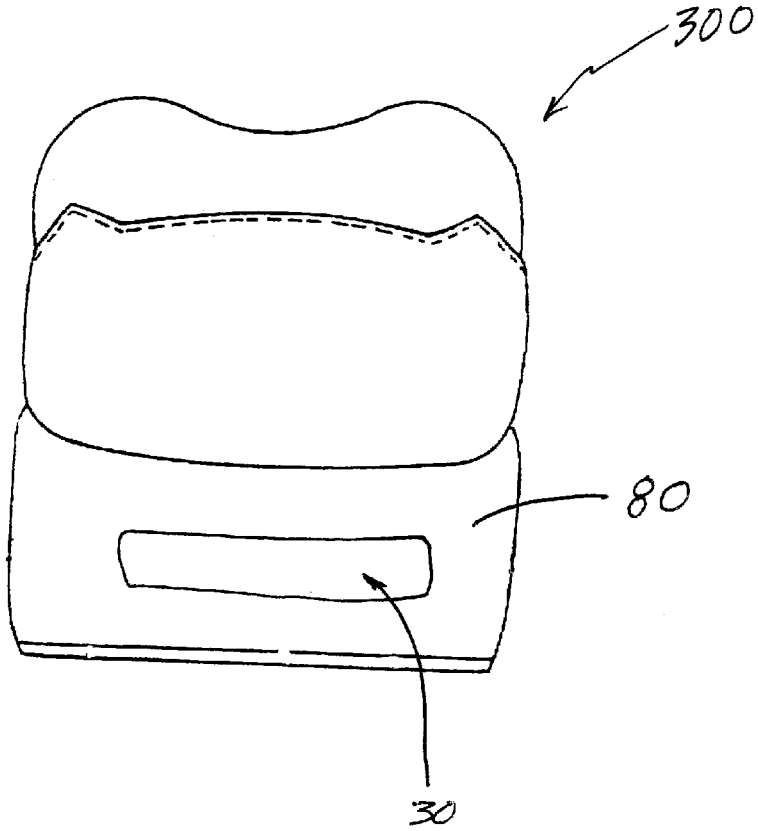
FIG. 14 is a rear view of the sports shoe of FIG. 13 illustrating a concealed storage cavity formed in the rear of the sole/heel area according to the present invention.
Figure 15:
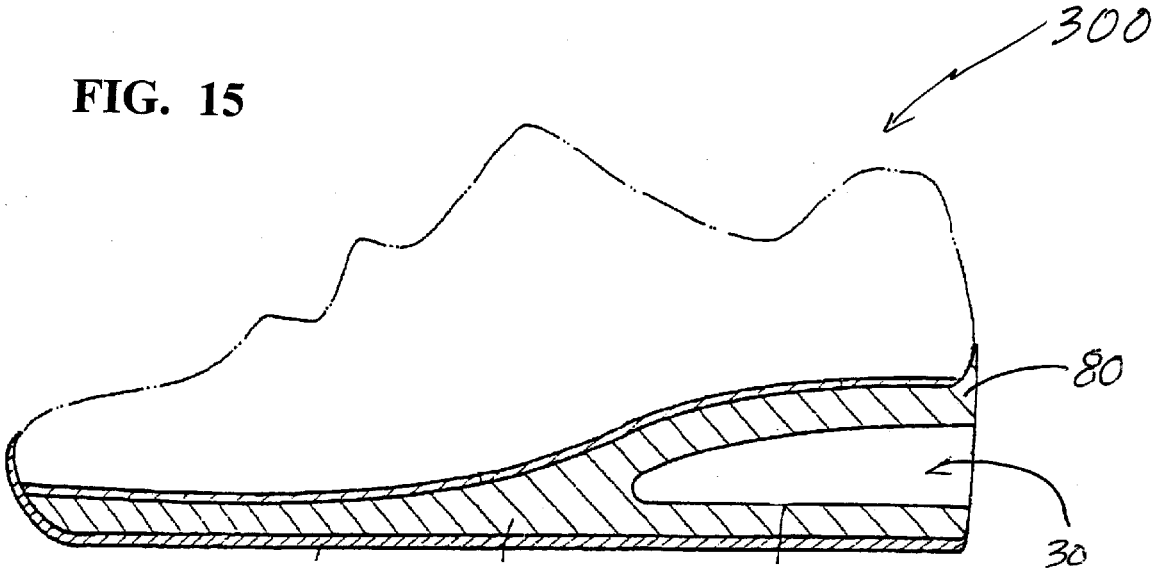
FIG. 15 is a partial side cross sectional view of the, sports shoe shown in FIG. 13 illustrating the concealed storage cavity according to the present invention.
Figure 16:
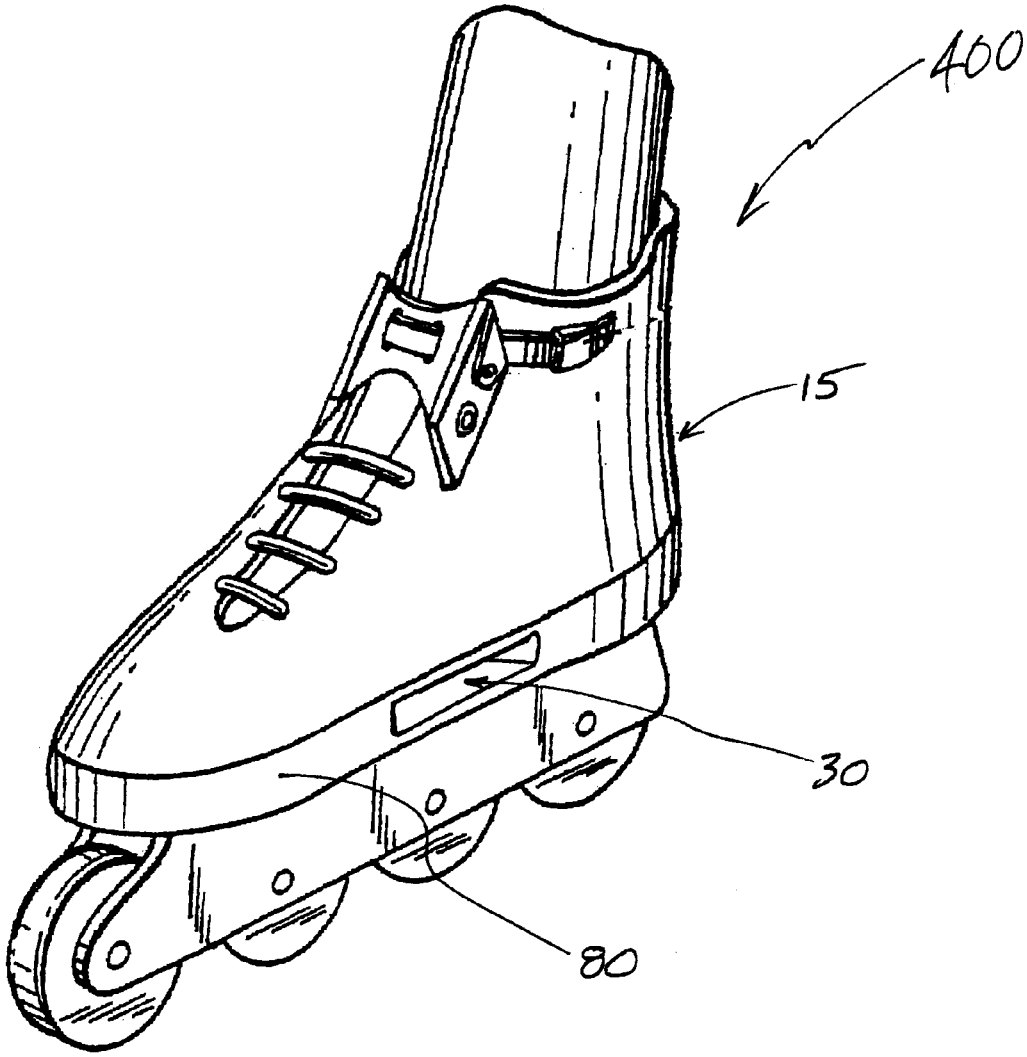
FIG. 16 is a perspective view of an in-line skate having a concealed storage cavity formed in sole/heel, portion according to the present invention.
Figure 17:
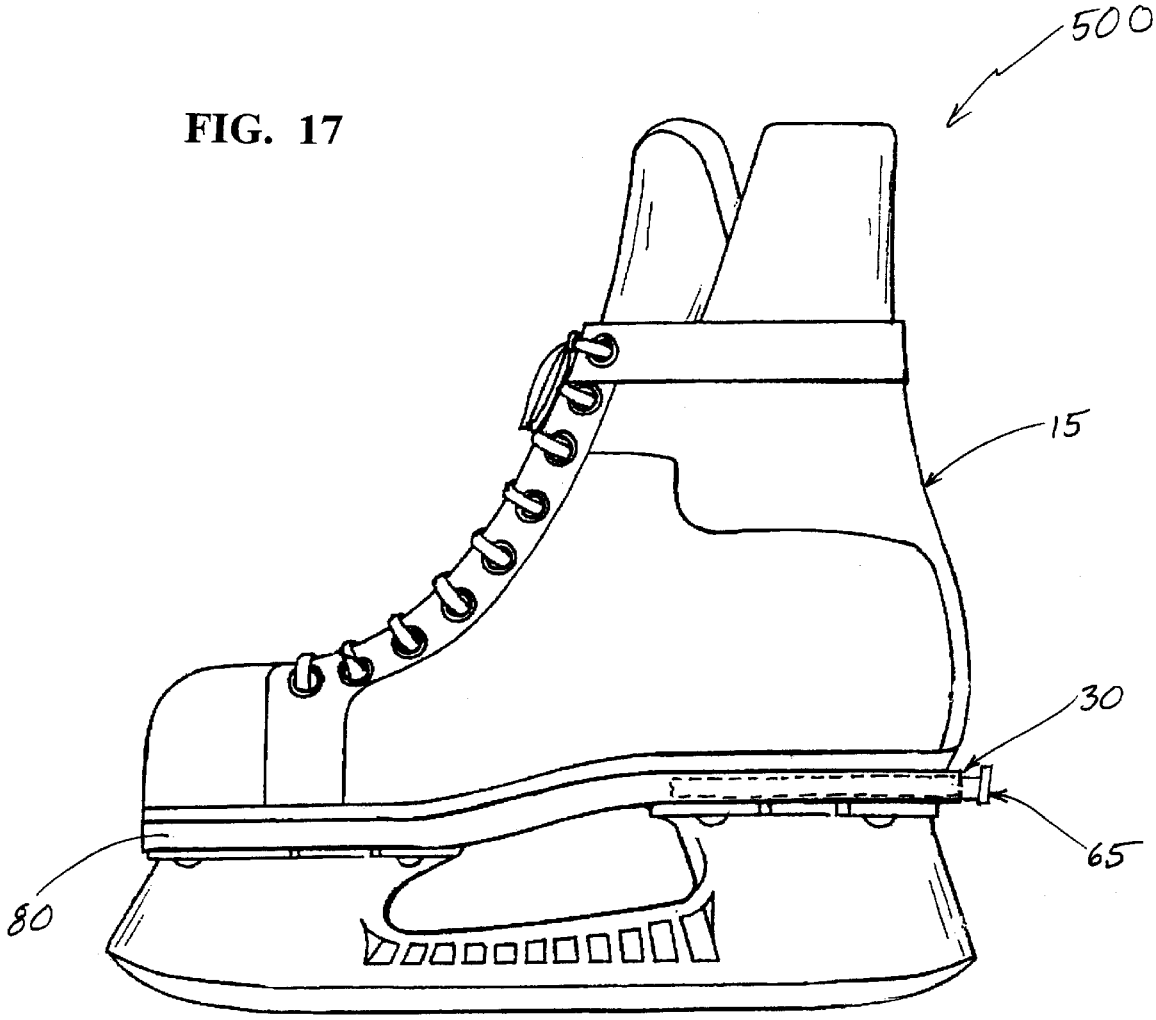
FIG. 17 is a side view of an ice skate having a concealed storage cavity formed in the sole/heel portion according to the present invention.

The foregoing embodiments show and describe the present invention as applied to women's dress shoes. It is to be readily understood, however, that the present invention finds application to virtually any conceivable type of footwear. By way of example only, FIGS. 9–12 illustrate the present invention applied to a boot 200; FIGS. 13–15 illustrate the present invention applied to a sports-shoe 300; FIG. 16 illustrates the present invention applied to an in-line skate 400; and FIG. 17 illustrates the present invention applied to an ice skate 500. In each instance, the article of footwear includes at least one concealed storage cavity 30 formed in one or more of the heel portion 20, sole portion 25, and sole/heel layer 80.

These embodiments, in conjunction with those shown and described above with reference to FIGS. 1–8, should make it perfectly clear to those skilled in the art that accessing the concealed storage cavity 30 of the present invention may be achieved in any number of different fashions without departing from the scope of the present invention. For example, as shown with reference to the boot 200, the concealed storage cavity 30 of the present invention may be accessed from the front of the heel 20 (FIG. 9), the back of the heel 20 (FIG. 10), or the bottom of the heel 20 and/or sole 25 (FIGS. 11 and 12). With reference to the sports shoe 300, the concealed storage cavity 30 of the present invention may be accessed through the back and/or side of the sole/heel portion 80 (i.e. FIGS. 13–15). With reference to the skates 400, 500, the concealed storage cavity 30 may be accessed through the side (FIG. 16) or the back (FIG. 17) of the sole/heel portion 80 disposed underneath the boot or foot-receiving portion 15. Although not necessarily shown in FIGS. 9–17, it is to be understood that each concealed storage cavity 30 may be equipped with additional containment members, including but not limited to, the door members 35 and/or article-carrying trays 65 shown and described above. It is also to be understood that these additional containment members may be equipped with any number of well-known closure mechanisms including, but not limited to, those described above.

The present invention overcomes the drawbacks of the prior art. By providing a concealed storage cavity within an article of footwear, a wearer can transport and store various personal items without the need for traditional article-carrying means. Women can carry certain personal items (i.e. money, credit cards, lipstick, keys, etc.) without the need for a purse or clutch, and men can carry certain personal items (i.e. money, credit cards, keys, etc.) without the need for a wallet. This reduces the risk of being targeted for theft in that criminals oftentimes select their victims after assessing whether the person is likely to have certain valuables in their possession, which are commonly carried in traditional article-carrying means such as purses or wallets. The present invention also provides advantages in terms of convenience by eliminating the need for such traditional article-carrying means. This is important for women, for example, in crowded social settings where purses and clutches may be cumbersome and prone to becoming lost or stolen. This is also important for men who find it uncomfortable and/or painful to carry wallets.

The foregoing embodiments meet the objectives of this invention as stated above. Since numerous modifications and changes will readily occur, it is not desired to limit the invention to the exact construction shown and described. Thus, all suitable modifications and equivalents may be resorted to, falling within the scope and spirit of the invention.

What is claimed is:

1. An article of footwear, comprising:

a foot-receiving portion;

a sole portion coupled to said foot-receiving portion;

a heel portion coupled to said sole portion, wherein a storage cavity is formed in at least one of said heel portion and said sole portion, said storage cavity having an aperture formed in a bottom surface of at least one of said heel portion and said sole portion; and an article-containment structure having an interior chamber for receiving articles therein, a generally cylindrical exterior dimensioned to be introduced through said aperture and into said storage cavity, and a closure mechanism for removably fixing said article-containment structure within said storage cavity such that said article-containment structure and said storage cavity are concealed to a person viewing said footwear, wherein said closure mechanism includes a mating thread and groove arrangement provided on said exterior of said article-containment structure and an interior surface of said storage cavity.

2. The article of footwear set forth in claim 1, wherein said storage cavity is formed in said heel portion of said article of footwear.

3. The article of footwear set forth in claim 2, wherein said article-containment structure includes a lower heel member which closes off said aperture when said article-containment structure is disposed within said storage cavity.

4. A method of carrying personal items, comprising the steps of:

(a) forming a storage cavity within at least one of a sole portion and a heel portion of an article of footwear, said storage cavity having an aperture formed in a bottom surface of at least one said heel portion and said sole portion;

(b) providing an article-containment structure having an interior chamber for receiving articles therein, a generally cylindrical exterior dimensioned to be introduced through said aperture and into said storage cavity, and a closure mechanism for removably fixing said article-containment structure within said storage cavity, wherein said closure mechanism includes a mating thread and groove arrangement provided on said exterior of said article-containment structure and an interior surface of said storage cavity;

(c) disposing personal items within said article-containment structure; and (d) introducing said article-containment structure through said aperture and into said storage cavity such that said article-containment structure and said storage cavity are concealed to a person viewing said footwear.

5. The method of carrying personal items set forth in claim 4, wherein said storage cavity is formed in said heel portion of said article of footwear.

6. The method of carrying personal items set forth in claim 5, wherein said article-containment structure includes a lower heel member which closes off said aperture when said article-containment structure is disposed within said storage cavity.

7. A method of manufacturing an article of footwear, comprising the step of:

(a) forming a storage cavity within at least one of a sole portion and a heel portion of said article of footwear, said storage cavity having an aperture formed in a bottom surface of at least one said heel portion and said sole portion; and (b) providing an article-containment structure having an interior chamber for receiving articles therein, a generally cylindrical exterior dimensioned to be introduced through said aperture and into said storage cavity, and a closure mechanism for removably fixing said article-containment structure within said storage cavity such that said article-containment structure and said storage cavity are concealed to a person viewing said footwear, wherein said closure mechanism comprises a mating thread and groove arrangement provided on said exterior of said article-containment structure and an interior surface of said storage cavity.

8. The method of manufacturing an article of footwear set forth in claim 7, wherein said storage cavity is formed in said heel portion of said article of footwear.

9. The method of manufacturing an article of footwear set forth in claim 8, wherein said article-containment structure includes a lower heel member which closes off said aperture when said article-containment structure is disposed within said storage cavity.

* * * * *